US006019355A

United States Patent [19]

Birdsell et al.

[11] Patent Number: 6,019,355

[45] Date of Patent: Feb. 1, 2000

[54] CONTRACTIBLE PORTABLE HUMIDIFIER

[75] Inventors: Walter Birdsell, Marlboro; Kenneth Ritsher, Watertown, both of Mass.; Jui-Shang Wang, Taipei, Taiwan

[73] Assignee: Honeywell Inc., Minneapolis, Minn.

[21] Appl. No.: 09/030,183

[22] Filed: Feb. 25, 1998

[51] Int. Cl.[7] ..... B01F 3/04

[52] U.S. Cl. ..... 261/66; 261/72.1; 261/142; 261/DIG. 65

[58] Field of Search ..... 261/66, 72.1, 142, 261/DIG. 65

[56] References Cited

U.S. PATENT DOCUMENTS

| | | | |
|---|---|---|---|
| 3,864,437 | 2/1975 | Blaszkowski | 261/72.1 |
| 4,303,601 | 12/1981 | Grimm et al. | 261/DIG. 65 |
| 4,540,529 | 9/1985 | Koszyk | 261/91 |
| 4,624,806 | 11/1986 | Koszyk | 261/91 |
| 4,734,561 | 3/1988 | Miller | 219/275 |
| 4,882,096 | 11/1989 | Rueben | 261/30 |
| 5,061,405 | 10/1991 | Stanek et al. | 261/72.1 |
| 5,131,070 | 7/1992 | Chiu et al. | 261/142 |
| 5,339,383 | 8/1994 | Marino | 261/142 |
| 5,361,322 | 11/1994 | Glucksman | 261/142 |

*Primary Examiner*—C. Scott Bushey
*Attorney, Agent, or Firm*—John E. Toupal; Harold G. Jarcho

[57] ABSTRACT

A portable humidifier having a base defining a boiler cavity; an evaporation mechanism for inducing evaporation of liquid within the boiler cavity; and a liquid supply including a contractible and expandible vessel having an outlet communicating with the boiler cavity and providing restricted liquid flow between the vessel and the cavity.

13 Claims, 6 Drawing Sheets

CONTRACTIBLE PORTABLE HUMIDIFIER

BACKGROUND OF THE INVENTION

This invention relates generally to a portable humidifier and, more particularly, to a portable humidifier which can be contracted into a compact form when not in use.

Humidifiers are used extensively to increase personal comfort by increasing the humidity level in enclosed environments. Many humidifiers are portable units which typically include a vapor producing mechanism such as a heater element and a container providing a source of liquid to be vaporized. To eliminate the requirement for frequent refilling most portable humidifiers utilize a sizable tank of, for example, one gallon or larger to provide sufficient operating capacity for overnight use. Such humidifiers, however, are rather bulky rendering them inconvenient to store or transport during travel.

For various reasons, including compactness, humidifier devices have been provided with collapsible water containers. Examples of such humidifiers are disclosed, for example, in U.S. Pat. Nos. 3,864,437; 4,540,529; 4,624,806; 4,734,561; and 4,882,096. However, prior collapsible type humidifiers have failed to provide satisfactory efficiency, portability, operational safety and convenience of use.

The object of this invention, therefore, is to provide an improved evaporative humidifier which can be easily stored and transported in addition to having a water storage capacity sufficient for reasonably lengthy periods of continuous use.

SUMMARY OF THE INVENTION

The invention is a portable humidifier having a base defining a boiler cavity; an evaporation mechanism for inducing evaporation of liquid within the boiler cavity; and a liquid supply including a contractible and expandible vessel having an outlet communicating with the boiler cavity and providing restricted liquid flow between the vessel and the cavity. When empty, the vessel can be contracted to facilitate storage or transport of the humidifier.

According to one feature of the invention, the liquid supply is adapted to maintain a given liquid level in said cavity. This feature allows efficient humidification in addition to significant liquid storage capacity.

According to another feature of the invention, the vessel is removably supported on the base. Removal facilitates filling of the vessel.

According to still another feature of the invention, the vessel has contractible bellows walls. Desired expansion and contraction of the vessel is provided by the bellows.

According to yet another feature of the invention, the base further defines a reservoir disposed horizontally adjacent to the cavity, a channel provides liquid communication therebetween, and the outlet is disposed in the reservoir at an elevation determining the given liquid level. These features enhance humidification efficiency of the humidifier.

According to a further feature of the invention, the vessel includes a bottom wall defining a fill opening, and a removable cap closing the fill opening and defining the outlet; the base further defines an engagement surface in the reservoir; and the liquid supply includes a valve retained by the cap and biased in a closed position sealing the outlet; the valve having an actuator stem arranged to contact the engagement surface and thereby open the valve to allow liquid flow through the outlet. Efficient liquid level control is provided by these features.

According to an important feature, the invention has a director mechanism defining an elongated passage having one end disposed to receive vapor from the boiler cavity and an opposite end for discharging vapor received therefrom, the director including a longitudinally contractible and expandable tubulation defining the passage. The elongated passage enhances safety by reducing discharged vapor temperature and can be contracted to facilitate storage or transport.

According to an additional feature of the invention, the tubulation is formed by a plurality of telescopically interconnected tubular segments. Desired contraction of the tubulation is provided by the tubular segments.

According to a significant feature, the invention includes a connector mechanism fixing an upper end of the vessel to the opposite end of the passage thereby providing sympathetic expansion and contraction of the vessel and tubulation.

According to other features, the invention includes a support collar secured around a bottom end of the vessel and the one end of the passage, the support collar being removably supported on a top surface of the base; and a latching mechanism for securing the connector mechanism to the base with the vessel and tubulation contracted. The support collar facilitates removal of the vessel for refilling and the latching mechanism retains the humidifier in a contracted condition during non-use.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 8:
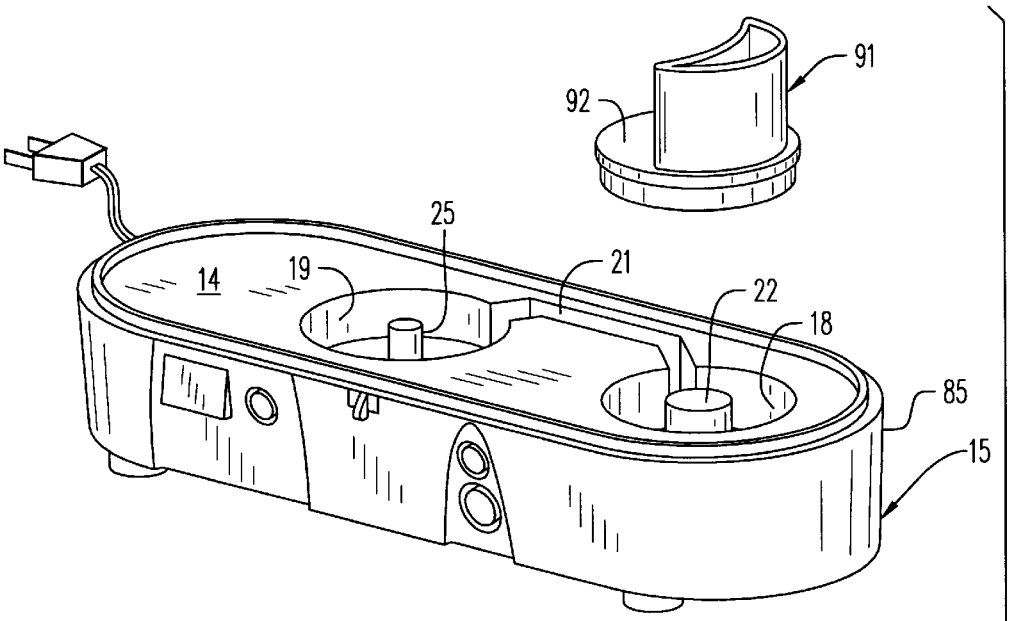
FIG. 8 is another top perspective view of the base showing a boiler cavity cover removed.

A portable humidifier 11 includes a liquid supply assembly 12 and a vapor director assembly 13 both removably mounted side by side on an upper surface 14 of a base 15. Defined by the upper surface 14 are a boiler cavity 18 and a reservoir 19 horizontally adjacent thereto as shown in FIG. 8. Liquid communication between the boiler cavity 18 and the reservoir 19 is provided by a liquid supply channel 21. Retained within the boiler cavity 18 is an electrical heater mechanism 22 which can be electrically energized to heat and thereby induce evaporation of liquid contained in the boiler cavity 18. Projecting upwardly into the reservoir 19 is a column 25 providing an upper engagement surface 26. A front wall 27 of the base 15 retains an electrical switch 28 for activating the heater mechanism 22 and a signal lamp 29 for indicating the operating status of the humidifier 11. Projecting outwardly from upper mid-portions of the front wall 27 of the base 15 and an oppositely directed rear wall 31 thereof are, respectively, latch tabs 32, 33.

Figure 9:
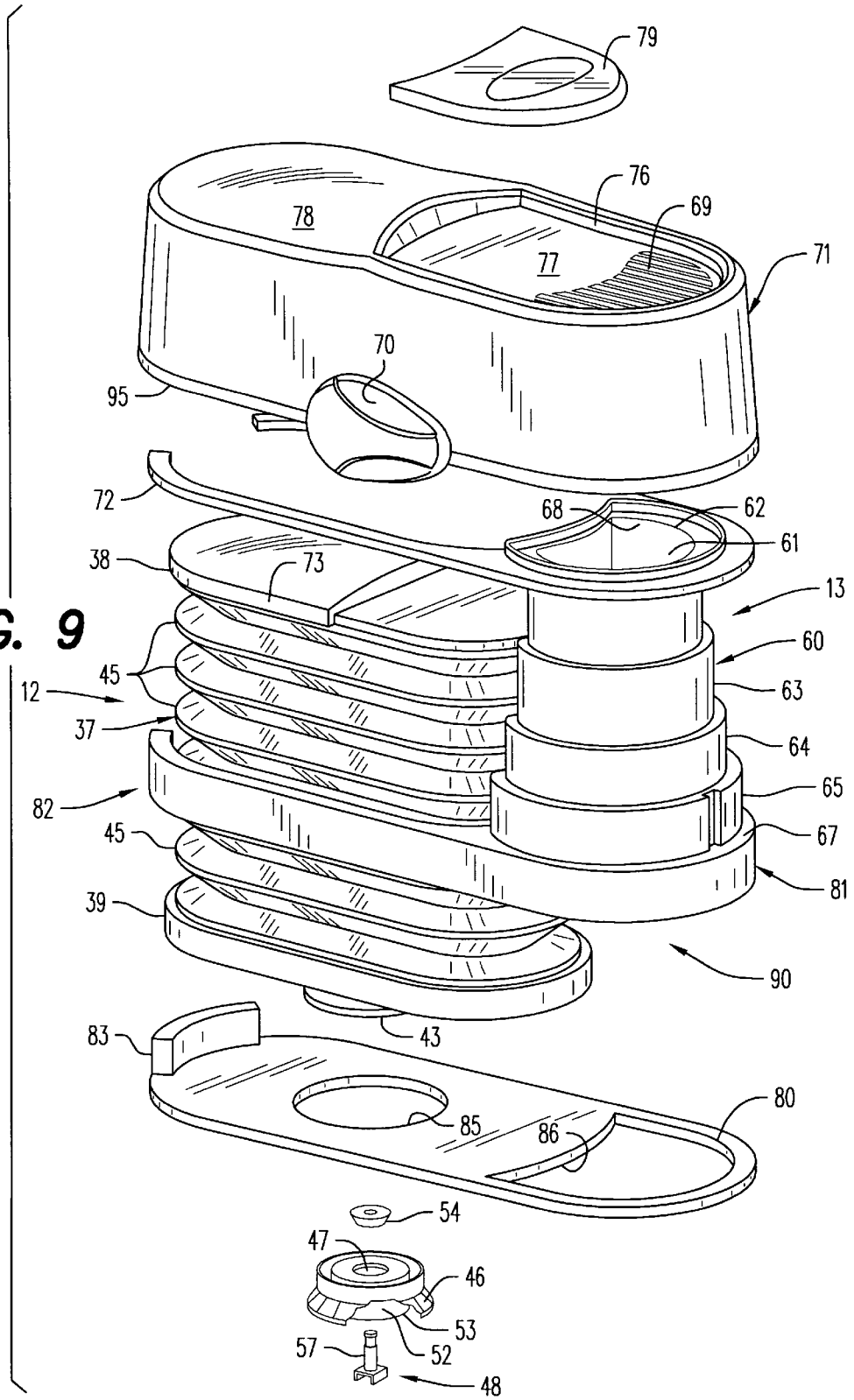
FIG. 9 is an exploded view showing liquid source and vapor director portions of the humidifier shown in FIG. 1.

The liquid supply assembly 12 includes an expandible and contractible vessel 37 having a closed upper end 38 and a bottom end 39 defining a fill opening 43 as depicted in FIG. 9. Forming side walls of the vessel 37 are a plurality of vertically interconnected, contractible and expandable bellows sections 45. The fill opening 43 is closed by a threaded, removable cap having a central liquid discharge orifice 47 which retains a valve assembly 48. Extending downwardly from the orifice 47 and communicating therewith, is a cylindrical skirt 52 having a lower end that defines an outlet 53 for the vessel 37. The valve assembly 48 includes a valve stopper 54 biased by a spring (not shown) into a closed position that closes the upper end of the orifice 47. A valve actuator stem 57 extends through the tube 52 and is attached to the valve stopper 54.

As illustrated in FIG. 9, an open ended, resilient collar 72 is shaped for snapping engagement within an inverted cup-shaped cover 71 for the supply and director assemblies 12 and 13. Pivotally supported on opposite sides of the cover 71 are pivotable latch arms 70. The collar 72 engages a lip 73 on the upper end 38 of the vessel 37 and a lip on the upper segment 62 forming the opposite discharge end 68 of the tubulation 60. Slidably retained in a slot 76 within a recess 77 in an upper surface 78 of the cover 71 is a lid 79 which can be reciprocated between an open position and a closed position covering the discharge opening 68 of the passage 61.

An open ended, mounting and support collar 81 is secured to and extends around the bottom end 39 of the vessel 37. Closing the bottom of the support collar 81 is a plate 80 having at one end an upwardly projecting rim portion 83. Opposite ends of the rim portion latch into engagement with, respectively, opposite ends of the support collar 81. Formed in the plate 82 are a circular opening 85 and an arcuate opening 86. The cover 71 and collar 81 combine the liquid supply assembly 12 and vapor director assembly 13 into a composite assembly 90.

Figure 7:
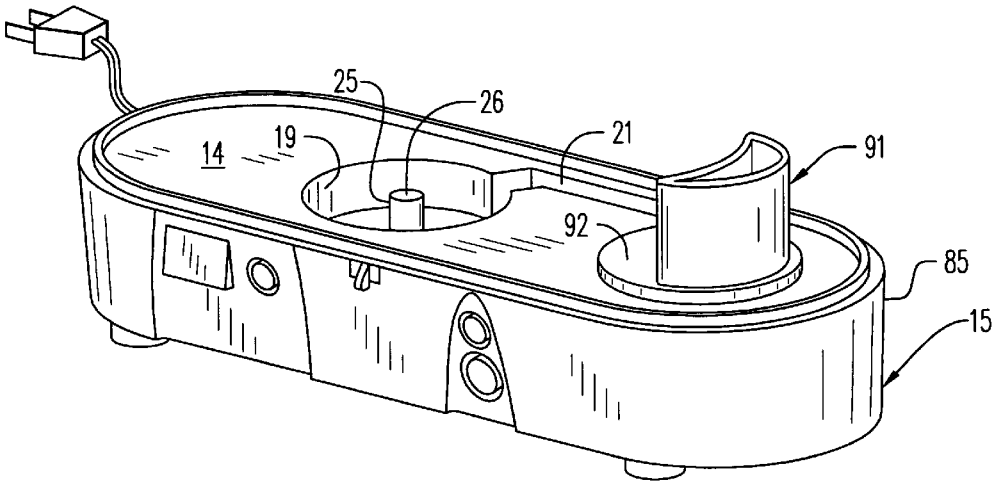
FIG. 7 is a top perspective view of a base portion of the humidifier shown in FIG. 1.

When the composite assembly 90 is mounted on the base 15, the bottom surface of the plate 82 is supported by the upper surface 14 (FIGS. 7 and 8) of the base 15. In those positions, the circular opening 85 provides access for the cap 46 into the reservoir 19 and the opening 86 receives an arcuate spout 91 with a circular bottom 92 that covers the boiler cavity 18. The spout 91 projects upwardly into the lower telescopic segment 65 and provides vapor communication between the boiler cavity 18 and the elongated tubulation 60.

OPERATION

Figure 1:
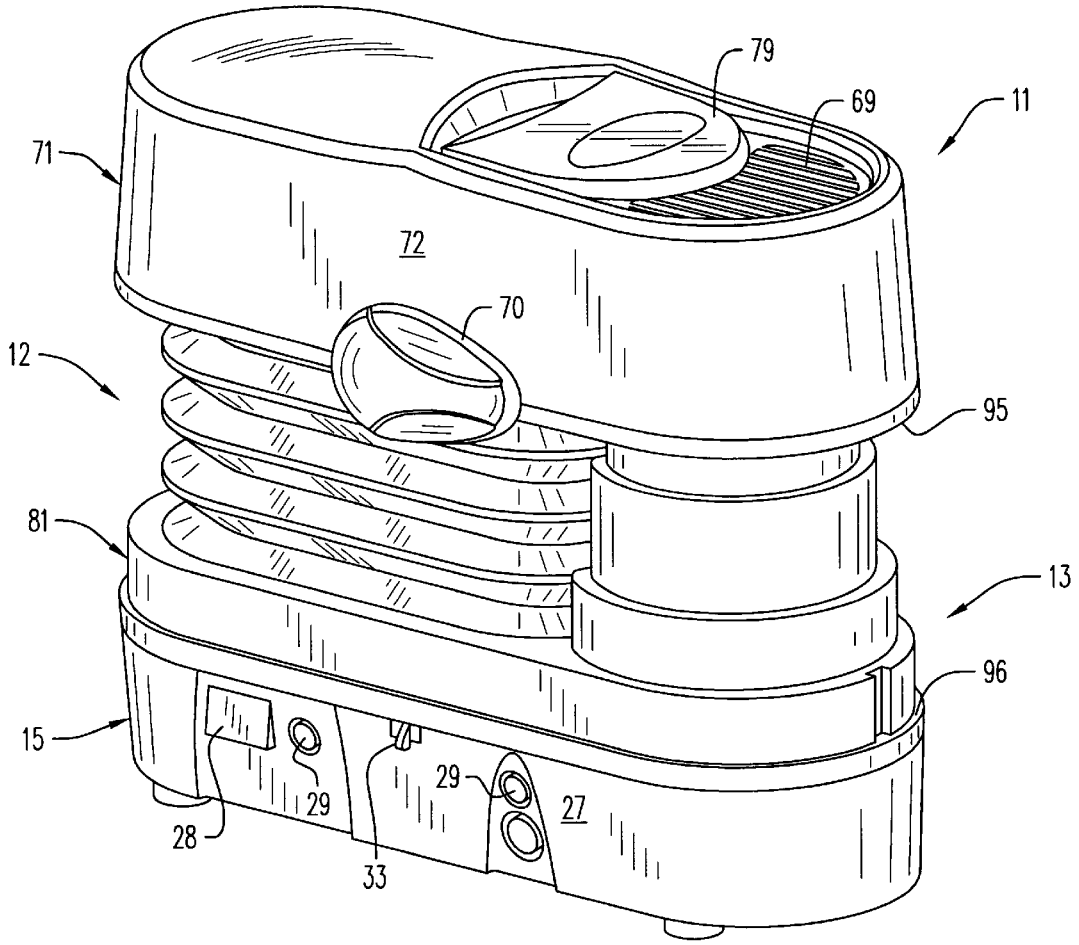
FIG. 1 is a front perspective view of a portable humidifier in an operating condition.
Figure 2:
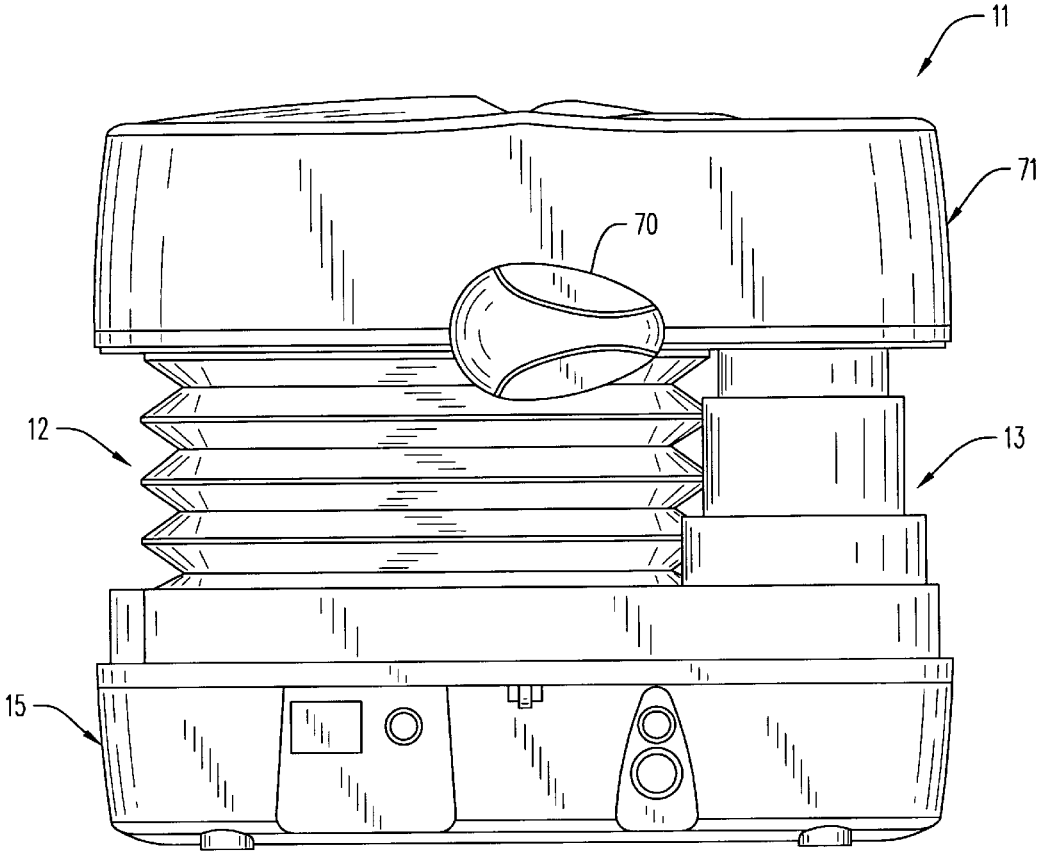
FIG. 2 is a front elevational view of the humidifier shown in FIG. 1.
Figure 3:
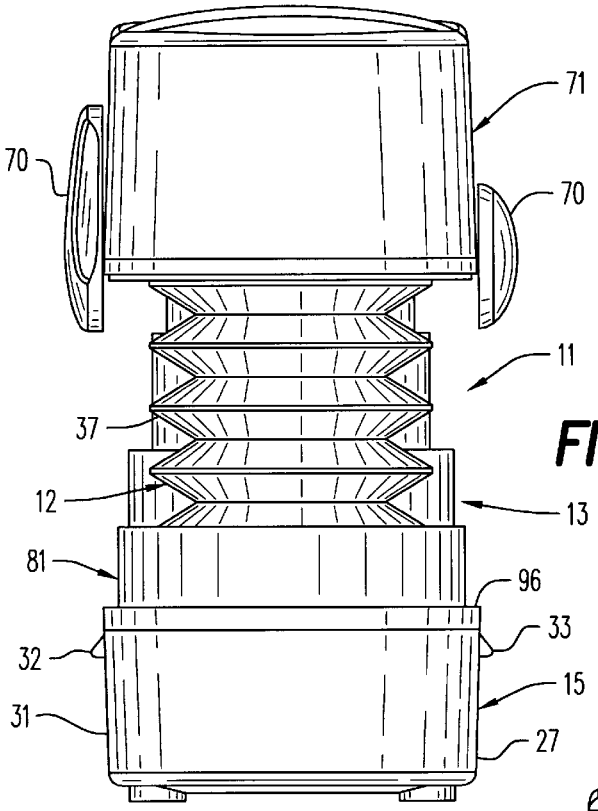
FIG. 3 is a left elevational view of the humidifier shown in FIG. 1.
Figure 4:
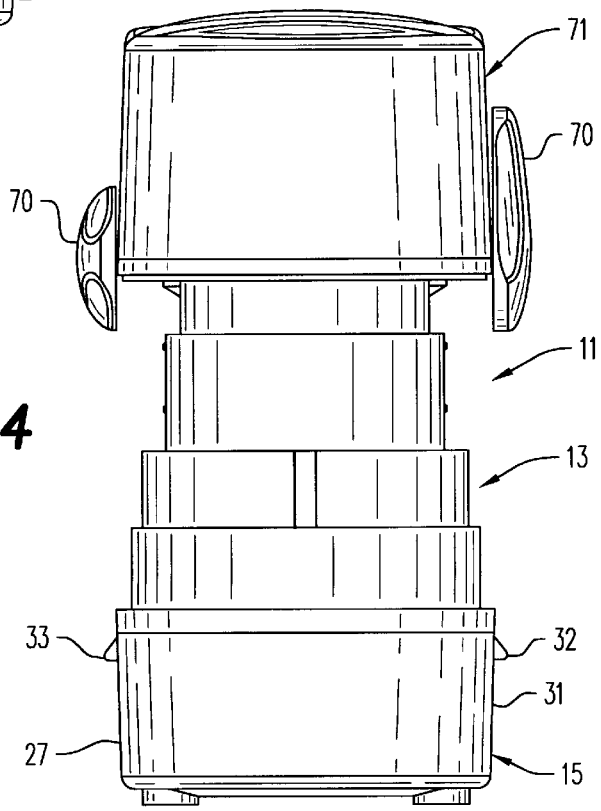
FIG. 4 is a right elevational view of the humidifier shown in FIG. 1.
Figure 5:
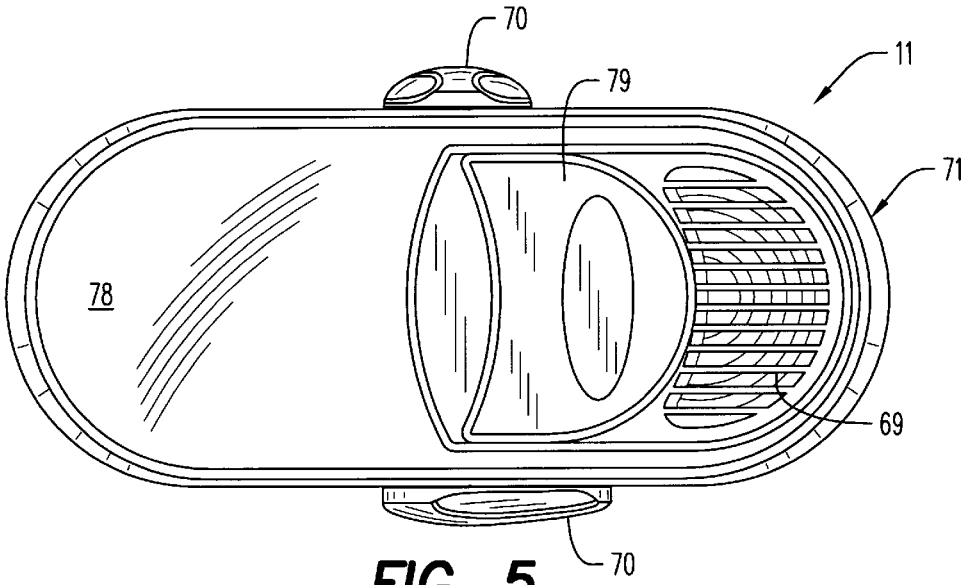
FIG. 5 is a top view of the humidifier shown in FIG. 1.
Figure 6:
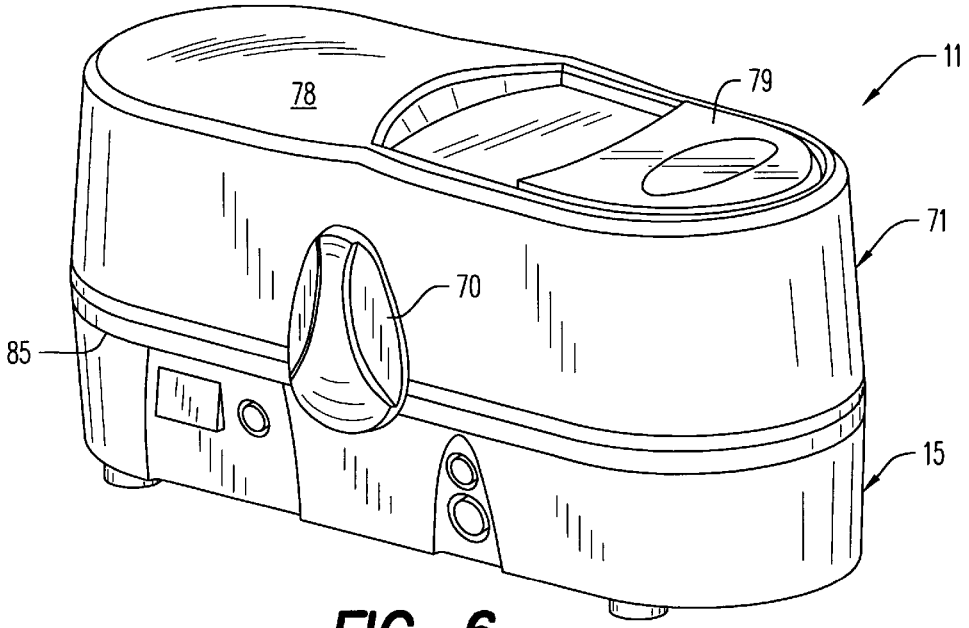
FIG. 6 is a front perspective view of the humidifier shown in a contracted condition.

When not being used as, for example, during periods of travel, the cover 71 can be forced downwardly producing sympathetic contraction of the bellows vessel 71 and telescopic tubulation 60. Upon engagement between a lower edge 95 of the cover 71 and an upper, outer shoulder 96 on the base 15, the latch arms 70 can be pivoted into engagement with the latch tabs 32, 33. The resultant latching action retains the humidifier 11 in a compact contracted state shown in FIG. 6. When humidification is desired, the latch arms 74 are rotated into release positions (FIG. 2) permitting removal of the composite assembly 90 from the base 15. After inversion of the composite assembly 90 and removal of the cap 46, the vessel 37 can be filled from a convenient source of liquid such as a conventional faucet. Filling of the vessel 37 induces expansion of the bellows sections 45 and sympathetic expansion of the movable telescopic segments 62–64 of the tubulation 60. After replacement of the cap 46 to close a fill opening 43, the composite assembly 90 is returned to its upright position on the base 15 as shown in FIGS. 1–5.

With the composite assembly 90 mounted on the base 15, the lower end of the valve stem 57 contacts the engagement surface 26 of the column 25 in the reservoir 19. That engagement moves the stem 57 and attached valve stopper 54 upwardly to open the orifice 47 and allow liquid flow out of the vessel 37 into the reservoir 19. Corresponding liquid flow occurs from the reservoir 19 into the boiler cavity 18 through the communication channel 21. Liquid flow continues until the outlet 53 is covered to establish a given liquid level in the boiler cavity 18 and reservoir 19.

After opening of the lid 79, the switch 28 then can be operated to energize the evaporative heater 22 in the boiler cavity 18. Resultant liquid evaporation in the boiler cavity 18 produces vapor which rises through the passage 61 in the tubulation 60 and is discharged through the discharge opening 68 into the surrounding environment. As liquid drains from the vessel 37, the rigidity of the bellows sections 45 maintain the fully expanded conditions of the composite assembly 90. Thus, the vapor director assembly 13 is maintained at maximum length to ensure desired cooling of the vapor released from the boiler cavity 18 before discharge from the discharge opening 68. If liquid remains in the vessel 37 after use of the humidifier 11 is completed, the composite assembly 90 again can be separated from the base 15 and the cap 46 removed to allow emptying of remnant liquid through the fill opening 43. Subsequently, the composite assembly 90 can be replaced on the base 15 and latched into the contracted state shown in FIG. 6. In that condition, the compact state of the humidifier 11 facilitates its movement during travel or allows convenient storage thereof.

Obviously, many modifications and variations of the present invention are possible in light of the above teachings. It is to be understood, therefore, that the invention can be practiced otherwise than as specifically described.

What is claimed is:

1. A portable humidifier comprising:

a base defining a boiler cavity;

an evaporation mechanism for inducing evaporation of liquid within said boiler cavity;

liquid supply means comprising a contractible and expandable vessel having an outlet communicating with said boiler cavity and providing restricted liquid flow between said vessel and said cavity; and director means defining an elongated passage having one end disposed to receive vapor from said boiler cavity and an opposite end for discharging vapor received therefrom, said director means comprising a longitudinally contractible and expandable tubulation defining said passage.

2. A portable humidifier according to claim 1 wherein said tubulation is formed by a plurality of telescopically interconnected tubular segments.

3. A portable humidifier according to claim 2 including a connector mechanism fixing an upper end of said vessel to said opposite end of said passage thereby providing sympathetic expansion and contraction of said vessel and said tubulation.

4. A portable humidifier according to claim 3 including latching means for securing said connector mechanism to said base with said vessel and said tubulation collapsed.

5. A portable humidifier according to claim 4 including a support collar secured around a bottom end of said vessel and said one end of said passage, said support collar being removably supported on a top surface of said base.

6. A portable humidifier according to claim 5 wherein said liquid supply means is adapted to maintain a given liquid level in said cavity.

7. A portable humidifier according to claim 6 wherein said vessel is removably supported on said base.

8. A portable humidifier according to claim 7 wherein said vessel has collapsible bellows walls.

9. A portable humidifier according to claim 8 wherein said base further defines a reservoir disposed horizontally adjacent to said cavity, and a channel providing liquid communication therebetween.

10. A portable humidifier according to claim 9 wherein said outlet is disposed in said reservoir at an elevation determining said given liquid level.

11. A portable humidifier according to claim 10 wherein said vessel comprises a bottom wall defining a fill opening, and a removable cap closing said fill opening and defining said outlet.

12. A portable humidifier according to claim 11 wherein said base further defines an engagement surface in said reservoir, said liquid supply means further comprises a valve retained by said cap and biased in a closed position sealing said outlet; said valve having an actuator stem arranged to contact said engagement surface and thereby open said valve to allow liquid flow through said outlet.

13. A portable humidifier according to claim 8 wherein said bellows walls are of sufficient rigidity to maintain said vessel in an expanded condition when empty.

* * * * *